US010256579B2

(12) United States Patent
Fuehrer et al.

(10) Patent No.: US 10,256,579 B2
(45) Date of Patent: Apr. 9, 2019

(54) PLUG CONNECTOR PART HAVING TEMPERATURE SENSORS

(71) Applicant: PHOENIX CONTACT E-MOBILITY GMBH, Schieder-Schwalenberg (DE)

(72) Inventors: Thomas Fuehrer, Blomberg (DE); Markus Rose, Paderborn (DE)

(73) Assignee: PHOENIX CONTACT E-MOBILITY GMBH, Schieder-Schwalenberg (DE)

( * ) Notice: Subject to any disclaimer, the term of this patent is extended or adjusted under 35 U.S.C. 154(b) by 0 days.

(21) Appl. No.: 15/504,343

(22) PCT Filed: Aug. 17, 2015

(86) PCT No.: PCT/EP2015/068852
§ 371 (c)(1),
(2) Date: Feb. 16, 2017

(87) PCT Pub. No.: WO2016/026813
PCT Pub. Date: Feb. 25, 2016

(65) Prior Publication Data

US 2017/0229820 A1 Aug. 10, 2017

(30) Foreign Application Priority Data

Aug. 19, 2014 (DE) ..... 10 2014 111 831

(51) Int. Cl.
*H01R 33/00* (2006.01)
*H01R 13/66* (2006.01)
*H01R 4/20* (2006.01)

(52) U.S. Cl.
CPC ..... *H01R 13/6683* (2013.01); *H01R 4/20* (2013.01); *H01R 2201/26* (2013.01)

(58) Field of Classification Search
CPC ..... H01R 2201/26; H01R 9/2425; H01R 13/6683
(Continued)

(56) References Cited

U.S. PATENT DOCUMENTS 4,915,639 A 4/1990 Cohn et al.
6,210,036 B1 * 4/2001 Eberle ..... H01R 13/6683 337/2
(Continued)

FOREIGN PATENT DOCUMENTS

EP 2605339 A1 6/2013
EP 2706628 A1 3/2014
(Continued)

*Primary Examiner* — Abdullah A Riyami
*Assistant Examiner* — Thang H Nguyen
(74) *Attorney, Agent, or Firm* — Leydig, Voit & Mayer, Ltd.

(57) ABSTRACT

In an embodiment, the present invention provides a plug connector part for connection to a mating plug connector part, including a plurality of electrical contact elements for carrying an electrical current and establishing electrical contact with contact elements of a mating plug connector part, the plurality of electrical contact elements including a plurality of temperature sensors, each of which is arranged on one associated contact element, respectively, of the plurality of contact elements, to detect a change in a temperature of the associated contact element, the temperature sensors being connected to a common sensor line.

9 Claims, 3 Drawing Sheets

(58) Field of Classification Search
USPC ..... 439/34, 620.21
See application file for complete search history.

(56) References Cited

U.S. PATENT DOCUMENTS

| | | | | |
|---|---|---|---|---|
| 8,325,454 | B2 * | 12/2012 | Brugner | H01R 13/6683 361/103 |
| 8,808,033 | B2 * | 8/2014 | White | H01R 13/6215 439/34 |
| 9,705,259 | B2 * | 7/2017 | Feldner | B60L 11/1818 |
| 2008/0214022 | A1 * | 9/2008 | Kowalick | H01R 13/443 439/34 |
| 2009/0251832 | A1 | 10/2009 | Brugner et al. | |
| 2012/0152302 | A1 * | 6/2012 | DeGraaff | H01R 13/6641 136/244 |
| 2014/0073189 | A1 * | 3/2014 | Kondou | H01R 13/7137 439/620.21 |
| 2016/0039297 | A1 * | 2/2016 | Kretschmer | B60L 11/1818 320/109 |
| 2016/0104978 | A1 * | 4/2016 | Chaumeny | H01R 13/6683 439/620.22 |
| 2016/0111831 | A1 * | 4/2016 | Kawai | H01R 13/04 439/620.21 |
| 2016/0322914 | A1 * | 11/2016 | Rodriguez Rios | H01F 38/30 |
| 2017/0141518 | A1 * | 5/2017 | Brux | H01R 13/514 |

FOREIGN PATENT DOCUMENTS

| | | | |
|---|---|---|---|
| GB | 2489988 | A | 10/2012 |
| WO | WO 0213330 | A1 | 2/2002 |

* cited by examiner

PLUG CONNECTOR PART HAVING TEMPERATURE SENSORS

CROSS-REFERENCE TO PRIOR APPLICATIONS

This application is a U.S. National Phase application under 35 U.S.C. § 371 of International Application No. PCT/EP2015/068852, filed on Aug. 17, 2015, and claims benefit to German Patent Application No. DE 10 2014 111 831.6, filed on Aug. 19, 2014. The International Application was published in German on Feb. 25, 2016 as WO 2016/026813 A1 under PCT Article 21(2).

FIELD

The invention relates to a plug connector part for connecting to a mating plug connector part.

BACKGROUND

A plug connector part may comprise a plurality of electrical contact elements for carrying an electrical current and for establishing electrical contact with contact elements of a mating plug connector part.

A plug connector part of this type can be a plug or a socket. A plug connector part of this type can be used in particular on a charging device for transmitting a charging current. The plug connector part can in particular be formed as a charging plug or charging socket for charging a motor vehicle driven by an electric motor (also referred to as an electric vehicle).

Charging plugs or charging sockets for charging electric vehicles are designed such that large charging currents can be transmitted. Since the thermal loss power increases quadratically with the charging current, the temperature of such charging plugs or charging sockets needs to be monitored in order to identify, in good time, when components of the charging plug or the charging socket are overheating and to modify the charging current or even to switch off the charging device if necessary.

In a charging plug known from EP 2 605 339 A1, a temperature sensor is arranged on an insulating body, approximately centrally between contact elements of the contact plug. The temperature sensor makes it possible to identify whether there is an excessive increase in temperature anywhere on the contact elements, in order to stop the charging process if necessary.

In a charging plug known from GB 2 489 988 A, a plurality of temperature sensors are provided which communicate temperature data via a line. A charging process is controlled depending on the temperature range in which the temperatures recorded at the temperature sensors lie.

U.S. Pat. No. 6,210,036 B1 discloses a plug connector, in which a plurality of temperature sensors are interlinked in series by means of a single-core line. The temperature sensors are arranged on an insulating body and exhibit a significant change in resistance at a pre-determined temperature that is so great that a control circuit connected to the line can detect the change and adapt the current flowing through the charging plug, switching it off if necessary.

U.S. Pat. No. 8,325,454 B2 discloses a plug, in which individual contacts are associated with thermistors which are interconnected in parallel and conductively switch a thyristor when a threshold temperature is exceeded in order to thus switch off a current flowing through the contacts.

In charging plugs known from the prior art, temperature sensors are in particular embedded in an insulating body. This is required for electrically insulating the temperature sensors from the contact elements, the temperature of which may rise. However, this simultaneously entails the disadvantage that a change in temperature of one of the contact elements is transmitted via the insulating body with a time delay and is therefore sensed at the temperature sensors with a time delay. Particularly in concepts which are intended to make it possible to quickly switch off a load circuit in the event of a fault, such temperature sensor arrangements are therefore sometimes unsuitable.

SUMMARY

In an embodiment, the present invention provides a plug connector part for connection to a mating plug connector part, comprising: a plurality of electrical contact elements configured to carry an electrical current and to establish electrical contact with contact elements of a mating plug connector part, the plurality of electrical contact elements including a plurality of temperature sensors, each of which is arranged on one associated contact element, respectively, of the plurality of contact elements, to detect a change in a temperature of the associated contact element, the temperature sensors being connected to a common sensor line.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
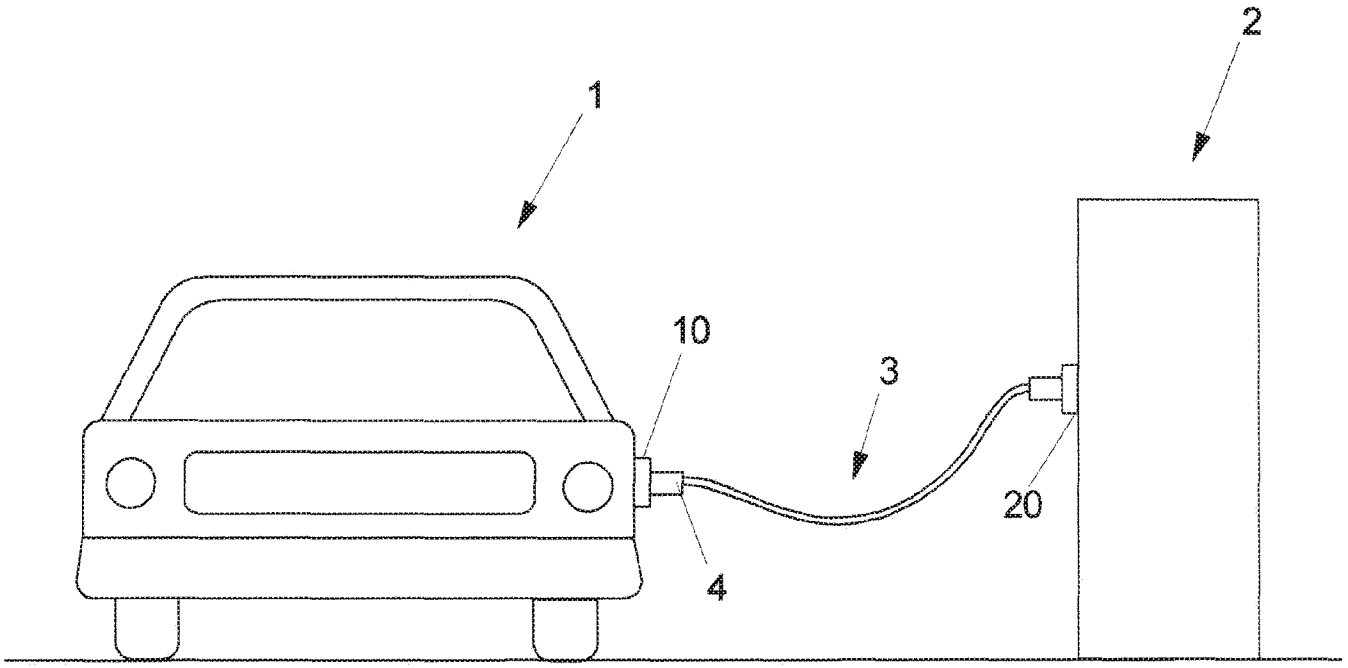
FIG. 1 is a schematic view of an electric vehicle together with a charging cable and a charging station for charging.

There is therefore a need for a temperature sensor device that can be constructed in a simple and cost-effective manner and that makes it possible for the temperature at the contact elements to be monitored in a manner having rapid response characteristics in order to quickly take countermeasures, for example rapidly switching off a charging current. In this case, it is also desirable for signals of a temperature sensor device of this type to be simple to evaluate in order to identify, in a cost-effective but nonetheless reliable manner, that one or more contact elements of the plug connector part are overheating.

Accordingly, in an embodiment of the present invention the plug connector part comprises a plurality of temperature sensors, each of which is arranged on one associated contact element, respectively, of the plurality of contact elements, in order to detect a change in the temperature of the associated contact element, the temperature sensors being connected to a common sensor line.

A basic concept of the present invention is that of associating each sensor element with one contact element, respectively. Individual temperature sensors can be arranged in particular on those contact elements that transmit large currents (referred to as power contacts) and that may thus overheat during operation, which temperature sensors generate a corresponding sensor signal when there is a rise in temperature of the contact element associated in each case, which signal can be evaluated in order to identify overheating.

Each sensor element is thus associated with one contact element, respectively, and is arranged on this contact element. In this case, the temperature sensors formed as discrete component parts are advantageously arranged directly on the electrically conductive metal contact elements, so that there is no need to interpose an additional insulating body between a temperature sensor and the associated contact element. This ensures rapid response characteristics because a rise in temperature of a contact element can be directly recorded and indicated by the associated temperature sensor.

In this case, in order to electrically insulate the sensor line and the contact elements from one another, the temperature sensors formed as discrete component parts are themselves electrically insulating and have, for example, an electrically insulating casing for this purpose, by means of which casing the temperature sensors are arranged on the respectively associated electrical contact elements. The sensor line connected to the temperature sensors is thus electrically (galvanically) isolated from the contact elements.

The temperature sensors are connected to a common sensor line and are interconnected in series by means of line portions of the sensor line, for example. Connecting the temperature sensors by means of a common sensor line makes it possible for the sensor signals provided by the temperature sensors to be evaluated together. This is based on the finding that, in order to monitor temperature, it is often not necessary to determine and evaluate the temperature of the individual contact elements separately, but instead all that is important is whether one of the contact elements is overheating, for example exceeding a temperature threshold value. Therefore, a common sensor line can be used to obtain and evaluate the information regarding whether one temperature sensor (or a plurality of temperature sensors) has detected an (inadmissible) increase in temperature of one contact element (or of a plurality of contact elements), whereupon, irrespective of which contact element precisely is overheating, appropriate countermeasures can be taken, for example a charging current can be controlled or switched off.

Connecting the temperature sensors in series by means of a common sensor line has the further advantage that the complexity of the circuit is reduced and only a few line portions are required in order to connect the temperature sensors in series. Such a series-connected arrangement of temperature sensors can be connected to an associated evaluation device in a simple manner by means of the sensor line in order to evaluate, in the evaluation device, sensor signals provided via the sensor line.

The temperature sensors can be formed as temperature-dependent resistors, for example. The temperature sensors can, for example, be resistors having a positive temperature coefficient (known as PTC resistors), the resistance value of which increases as the temperature increases (also referred to as posistors, which have good electrical conductivity at low temperatures and a reduced electrical conductivity at higher temperatures).

In a specific embodiment, the temperature sensors, formed as temperature-dependent resistors, can have a non-linear temperature characteristic, for example. Temperature-dependent resistors of this kind can be made of a ceramic material for example (ceramic PTC resistors) and exhibit a sharp increase in resistance at a material-specific temperature. If the material-specific temperature is exceeded, the resistance at the temperature sensor thus increases sharply in a non-linear manner, and this can be identified as a temperature threshold value being exceeded and can be evaluated accordingly.

Thus, when the temperature sensors are connected in series, the electrical resistance in the sensor line increases overall when the resistance value at one temperature sensor increases, and this can be evaluated accordingly by an evaluation device. In this case, the temperature threshold value at which the resistance value increases (sharply) can be set in the desired manner on the basis of the material of the temperature-dependent resistors.

In principle, electrical resistors having a negative temperature coefficient (known as NTC resistors) can also be used, the resistance value of which drops as the temperature increases. Resistors of this kind can be interconnected in parallel by means of line portions, for example, and therefore evaluation can again occur via a common sensor line.

For the purpose of evaluation, a constant current can be driven through the sensor line via an evaluation device, for example, in order to determine and evaluate the resulting voltage drop across the sensor line. If the resistance value in the sensor line increases, the voltage drop across the sensor line will increase if the current remains constant, and this can be evaluated in order to identify that a location in the plug connector part is overheating. In a cost-effective variant, the sensor line can also be part of a voltage divider. In this case, when the temperature changes, there is a change both in the current and in the voltage drop across the line comprising the temperature sensors arranged therein.

An evaluation device of this kind is connected to the sensor line and evaluates a sensor signal provided via the sensor line. An evaluation device of this kind can be arranged inside a housing of the plug connector part, for example, or can also be located outside the housing of the plug connector part and can be a component of a charging station, for example. In this case, the sensor line of the plug connector part is connected to the (external) evaluation device, for example when a charging cable, of which the plug connector part is a component, is connected to the charging station.

In general, the evaluation device can be designed to identify, on the basis of the sensor signal, that at least one of the contact elements has exceeded a temperature threshold value. This permits simple, reliable evaluation without significant outlay. For example, when it is identified that one or more contact elements have exceeded a temperature threshold value, a current flowing across the contact elements, in particular a charging current, can be immediately switched off.

The temperature sensors are arranged (directly) on the contact elements. For example, the temperature sensors can each be connected to a shank of an associated contact element. The shank is arranged at an end of the contact element that is remote from a head of the relevant associated contact element. The contact element can be plugged into a further contact element of a mating plug connector part by means of the head. The shank can extend into a chamber of a housing of the plug connector part, for example, which chamber is remote from a plug-in portion by means of which the plug connector part can be plugged into the mating plug connector part.

In principle, various options for connecting the temperature sensors to the associated contact elements are conceivable and possible. For example, the temperature sensors can be crimped to the contact elements by means of crimp sleeves that surround the temperature sensors. Crimp sleeves of this kind can be made of a material having good thermal conductivity, for example a metal, so that the crimp sleeve provides good thermal coupling of the temperature sensors to the contact elements.

However, it is also conceivable and possible, for example, to stick the temperature sensors to the contact elements or to connect said sensors to the contact elements in another manner.

FIG. 1 is a schematic view of a vehicle 1 in the form of a vehicle driven by an electric motor (referred to in the following as an electric vehicle). The electric vehicle 1 comprises electrically chargeable batteries, by means of which an electric motor can be supplied with electrical power to move the vehicle 1.

In order to charge the batteries of the vehicle 1, the vehicle 1 can be connected to a charging station 2 via a charging cable 3. For this purpose, one end of the charging cable 3 can be inserted into an associated charging socket 10 of the vehicle 1 by means of a plug connector part 4 and the other end thereof is electrically connected to a suitable charging socket 20 on the charging station 2. Charging currents having a comparatively high current strength are transmitted to the vehicle 1 via the charging cable 3.

Figure 2:
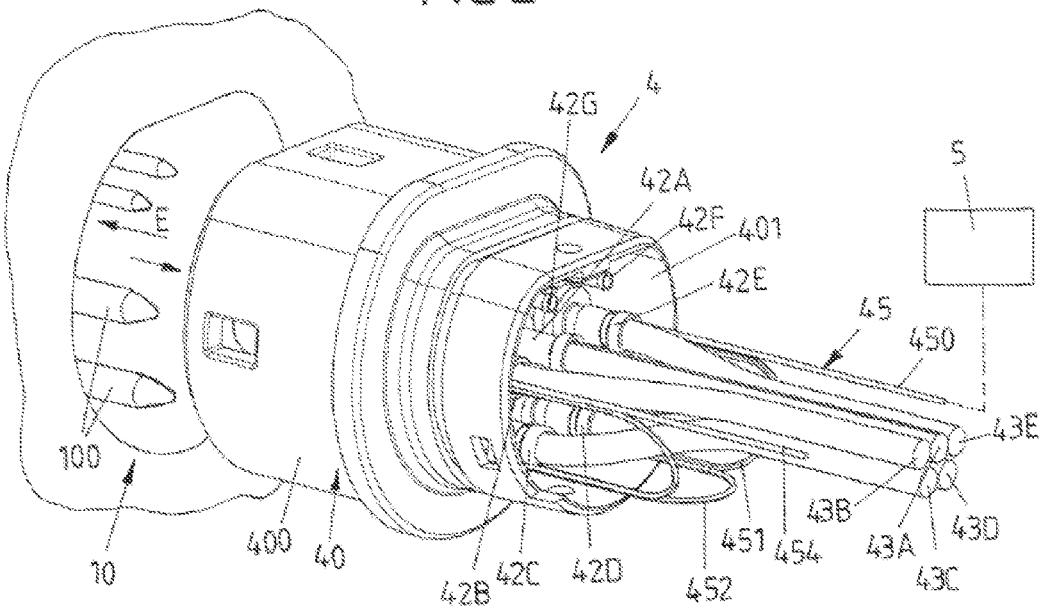
FIG. 2 is a perspective view of a plug connector part.

FIG. 2 shows an embodiment of a plug connector part 4 that can be a component of a charging cable 3, for example, and that connects the charging cable 3 to a charging socket 10 of a vehicle 1. The plug connector part 4 comprises a housing 40 having a plug-in portion 400 that is arranged thereon and into which contact elements 42A-42G comprising heads 420 (see FIG. 3) protrude so that the contact elements 42A-42G can be brought into plugged engagement with contact pins 100 of the charging socket 10 by plugging the plug-in portion 400 into an associated charging socket 10.

The contact elements 42A-42G protrude, by means of shanks 421, into a rear chamber 401 of the housing 40 of the plug connector part 4 that is remote from the plug-in portion 400, and are connected, by means of line receiving portions 422 arranged on the shanks 421, to associated lines 43A-43E that transmit a single-phase or multiphase charging current.

While the central contact element 42A having the associated line 43A acts as a protective earth conductor (PE), for example, the contact elements 42B-42E, also referred to as "power contacts", that are arranged in a semicircle around the central contact element 42A and have the associated lines 43B-43E, transmit phases of a charging current.

In particular, the contact elements 42B-42E acting as power contacts can overheat on account of the large current flowing during charging, for example when a defect occurs at one of the power contacts 42B-42E during operation and thus a high thermal loss power occurs locally.

Figure 6:
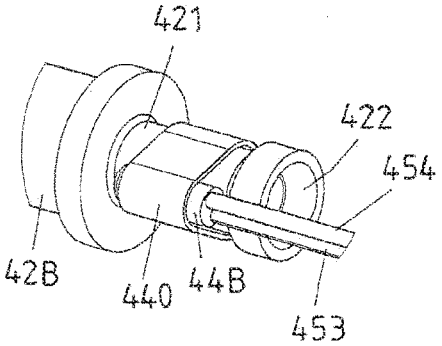
FIG. 6 is an enlarged view of a temperature sensor on a shank of a contact element of the plug connector part.

In order to identify that the contact elements 42B-42E acting as power contacts are overheating, temperature sensors 44B-44E in the form of temperature-dependent resistors having a positive temperature coefficient (known as PTC resistors) are arranged on these contact elements 42B-42E, the resistance value of which resistors increases as the temperature increases. The temperature sensors 44B-44E are each arranged on the shank 421 of the respectively associated contact elements 42B-42E and are connected to the shank 421 by means of a crimp sleeve 440 made of a material having high thermal conductivity (see FIG. 6).

As shown in FIG. 3 to 6, the temperature sensors 44B-44E are formed as discrete component parts and are directly adjacent to the metal, electrically conductive shank 421 of the respectively associated contact elements 42B-42E. Since the temperature sensors 44B-44E are thus in direct contact with the contact elements 42B-42E, the contact elements 42B-42E and the temperature sensors 44B-44E are thermally coupled together in an advantageous manner such that a rise in temperature of a contact element 42B-42E leads immediately, i.e. without a significant time delay, to a change in resistance of the associated temperature sensor 44B-44E and the temperature change can thus be swiftly identified.

In order to electrically insulate the temperature sensors 44B-44E, formed as discrete component parts, from the contact elements 42B-42E, the temperature sensors 44B-44E are electrically insulated on the surfaces thereof that are in contact with the contact elements 42B-42E, and are surrounded by a casing made of an electrically insulating material, for example. A sensor line 45 connected to the temperature sensors 44B-44E is thus electrically isolated from the contact elements 42B-42E.

Figure 3:
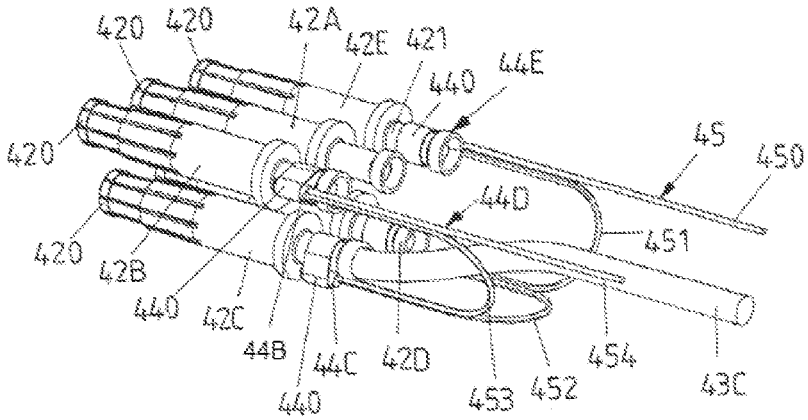
FIG. 3 is a separate view of contact elements of the plug connector part.
Figure 4:
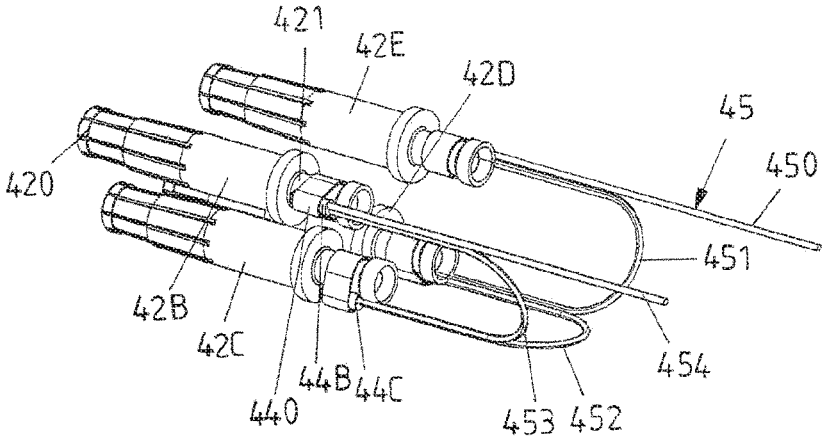
FIG. 4 is a separate view of the contact elements of the plug connector part that act as power contacts, comprising temperature sensors arranged thereon.
Figure 5:
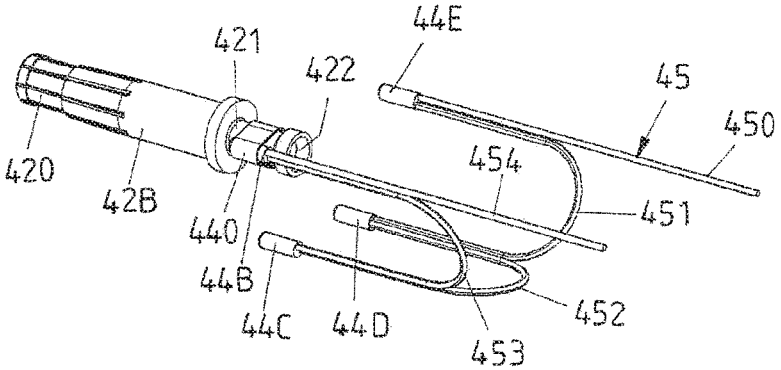
FIG. 5 is a separate view of a contact element of the plug connector part.

The temperature sensors 44B-44E are interconnected in series by means of a single-core sensor line 45 (see FIG. 3 to 5). Thus, one line portion 454 of the sensor line 45 extends to a first temperature sensor 44B, from there a second line portion 453 extends to a second temperature sensor 44C, a third line portion 452 extends to a third temperature sensor 44D, from there a fourth line portion 451 extends to a fourth temperature sensor 44E, and from there a fifth line portion 450 extends away. The sensor line 45 is connected to an evaluation device 5 (shown schematically in FIG. 2) by means of the first and the fifth line portion 454, 450 so that overheating of one or more contact elements 42B-42E and an associated change in resistance of one or more temperature sensors 44B-44E can be identified and evaluated via the common sensor line 45.

The evaluation device 5 is designed, for example, to impress a constant current in the sensor line 45 and to evaluate a resulting voltage drop. If the voltage drop increases while the current is constant, this indicates an increase in resistance in the sensor line 45 and thus a change in resistance of one or more of the temperature sensors 44B-44E.

As has been stated, the temperature sensors 44B-44E can be formed as temperature-dependent resistors having a positive temperature coefficient, for example, and can have a non-linear characteristic curve, for example. The temperature-dependent resistors 44B-44E can be made of a ceramic material, for example, that exhibits a sharp, non-linear increase in resistance at a material-specific temperature. A temperature threshold value can thus be set by selecting a suitable material, which temperature threshold value being exceeded results in a (large) change in resistance that can be detected by the evaluation device 5. If a corresponding increase in resistance in the sensor line 45 is detected, it is concluded that at least one of the contact elements 42B-42E is overheating and an appropriate countermeasure, for example controlling the charging current or switching off the charging current, is triggered.

The basic concept of the invention is not limited to the embodiments described above, but can in principle also be implemented in a completely different manner.

In particular, a plug connector part of the type described here can be used not only on a charging device for charging a vehicle, but can also be used in other plug connector parts in order to establish an electrical connection.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 vehicle
10 charging socket
100 contact pins
2 charging station
20 charging socket
3 charging cable
4 plug connector part
40 housing
400 plug-in portion
401 chamber
receiving opening
42A-42G contact element (contact socket)
420 socket head
421 shank
422 line receiving portion
43A-43E line
44B-44E temperature sensor
440 crimp sleeve
45 sensor line
450 fifth line portion
451 fourth line portion
452 third line portion
453 second line portion
454 first line portion
5 evaluation device
E insertion direction

The invention claimed is:

1. A plug connector part for connection to a mating plug connector part, comprising:

a plurality of electrical contact elements configured to carry an electrical current and to establish electrical contact with contact elements of a mating plug connector part, the plurality of electrical contact elements including a plurality of temperature sensors, each of which is arranged on one associated contact element respectively of the plurality of contact elements, to detect a change in a temperature of the associated contact element, the temperature sensors being connected to a common sensor line, wherein the temperature sensors are electrically interconnected in a series circuit by line portions of the sensor line, each of the line portions directly connecting two of the temperature sensors with each other.

2. The plug connector part according to claim 1, wherein the temperature sensors comprise temperature-dependent resistors.

3. The plug connector part according to claim 2, wherein an electrical resistance of each temperatures sensor increases as the temperature increases.

4. The plug connector part according to claim 1, wherein the temperature sensors have a non-linear temperature characteristic.

5. The plug connector part according to claim 1, further comprising an evaluation device to which the sensor line is connected and which is configured to evaluate a sensor signal provided via the sensor line.

6. The plug connector part according to claim 5, wherein the evaluation device is configured to identify, on the basis of the sensor signal, that at least one of the contact elements has exceeded a temperature threshold value.

7. The plug connector part according to claim 1, wherein the temperature sensors are each arranged on an electrically conductive shank of the respective associated contact elements.

8. The plug connector part according to claim 7, wherein the shank is arranged at an end of the respective associated contact element that is remote from a head of the respective associated contact element, the head of the contact element being configured to be plugged into a further contact element of a mating plug connector part.

9. The plug connector part according to claim 1, wherein the temperature sensors are crimped to associated contact elements by a crimp sleeve.

* * * * *